US006112565A

United States Patent [19]

Aramburu

[11] Patent Number: 6,112,565

[45] Date of Patent: Sep. 5, 2000

[54] COMBINATION CYLINDER THAT CAN BE EXTRACTED FROM THE OUTSIDE FOR A LATCH

[75] Inventor: Luis Angel Ruano Aramburu, San Sebastian, Spain

[73] Assignee: Talleres de Escoriaza S.A., Spain

[21] Appl. No.: 09/160,644

[22] Filed: Sep. 25, 1998

[30] Foreign Application Priority Data

Mar. 4, 1998 [EP] European Pat. Off. ..... 9800457

[51] Int. Cl.[7] ..... E05B 27/00

[52] U.S. Cl. ..... 70/360; 70/368

[58] Field of Search ..... 70/360, 367–371

[56] References Cited

U.S. PATENT DOCUMENTS

| | | | |
|---|---|---|---|
| 2,073,583 | 3/1937 | Olson | 70/368 |
| 2,141,748 | 12/1938 | Hansen | 70/368 X |
| 3,434,316 | 3/1969 | Neary | 70/368 X |
| 3,526,111 | 9/1970 | Jacobi | 70/368 |
| 3,943,737 | 3/1976 | Lerro | 70/360 X |
| 4,222,253 | 9/1980 | Peitsmeier | 70/368 X |
| 4,404,825 | 9/1983 | Dixon et al. | 70/368 |
| 4,565,080 | 1/1986 | Kincaid et al. | 70/360 X |
| 4,611,477 | 9/1986 | Crites | 70/360 X |
| 4,903,512 | 2/1990 | Leroy et al. | 70/360 X |
| 5,285,667 | 2/1994 | Fukusawa et al. | 70/360 X |
| 5,640,864 | 6/1997 | Miyamoto | 70/360 X |

FOREIGN PATENT DOCUMENTS

| | | | |
|---|---|---|---|
| 2366072 | 9/1977 | Germany | 70/368 |
| 4008649 | 9/1991 | Germany | 70/368 |
| 1455444 | 11/1976 | United Kingdom | 70/368 |

*Primary Examiner*—Suzanne Dino Barrett
*Attorney, Agent, or Firm*—Nields, Lemack & Dingman

[57] ABSTRACT

Combination cylinder that can be extracted from the outside for a latch, characterized in that support (4) of cylinder (3) has a radial catch piece (6) that can be retracted relative to a radial slot (7) of the internal wall of the static body (5) attached to the door, and there is a transverse lift-bar (8), a counter-spring push-button (9) and one each first (10) and second (11) openings attached in permanent axial alignment with said push-button (9); said lift-bar (8) has a first arm (8*a*) joined in an articulating manner with said retractable catch piece (6), a second arm (8*b*) with one end that can interfere with the rotary path of radial projection (13) present in cylinder (3).

4 Claims, 5 Drawing Sheets

14
13
14
13

19
6

19
IV
6
IV 8a
8
8b
8c
VII
VII 17
10
IX
IX 17
10

8
8c
9a
9
9b

COMBINATION CYLINDER THAT CAN BE EXTRACTED FROM THE OUTSIDE FOR A LATCH

FIELD OF THE INVENTION

The subject of the invention is particularly designed for a latch of the type that is pushed by a transverse axis, which can be placed in rotation both from a leg piece existing on the inside of the door, as well as from a combination cylinder that is installed on the outside and that is actuated by means of a corresponding key, in such a way that the lock can be applied and retracted from either side of the door in any circumstance. The combination cylinder is adjusted by axial sliding from back to front into the recess of a support, which in turn, is mounted in a body that is attached to the door by means of several threaded bolts that are applied from the escutcheon of the inside leg piece and by means of the interior housing of the latch, and strongly bind this interior escutcheon and said exterior body.

BACKGROUND OF THE INVENTION

When there are changes of owners or temporary occupants in buildings (apartments, shops, etc.), it is necessary to invalidate the old keys for the locks and to validate new ones.

The valid coding of a key is established by sets of slots that operate between the barrel and the tube of the combination cylinder, so that it is possible to modify the opening code (and, therefore, the valid key necessary) without the necessity of having to substitute the remainder of the cylinder and the lock. Nevertheless, for this, it is necessary to extract the cylinder of the lock, which requires a slow and costly labor for demounting and remounting from this lock.

In order to carry out the extraction of the cylinder without having to disassemble the rest of the lock, a system is known that consists of making a special cylinder that can be extracted by means of a special master key that operates under the power of professional locksmiths and upon which has been copied the code of the user's key of this lock.

One important problem in this system is that it requires making up a special basic and costly assembly, i.e., the combination cylinder. This adversely affects standardization in the production and marketing of the product. Moreover, it cannot be applied in traditional locks that are lacking such a special cylinder.

SUMMARY OF THE INVENTION

This invention proposes a new combination cylinder that is designed to be extracted by and from the external side of the door, according to a concept that has not been known up to now, and which is very simple, efficacious and advantageous.

Thus, according to the invention, the mentioned support, in which the new combination cylinder is installed, has a radial catch piece that is elastically retractable and capable of adopting several retracted and extended positions, which are respectively outside and inside, with respect to the mounting state of this support, at a reciprocal radial slot of the internal wall of said static body; there is also a lift-bar of transverse plane to said cylinder, a parallel counter-spring push-button at said cylinder, one each primary and secondary openings that are attached in permanent axial alignment with said push-button and that are respectively made in the back and in a front escutcheon of said support and a radial projection formed in a clip washer of the type commonly used for the intrinsic mounting of said cylinders; in which, with respect to the mounting state of said support, said lift-bar has a first arm joined in articulation with said retracting catch piece, a second arm that holds its adjacent end at a first rotating path effected by said radial projection upon rotating said cylinder in the counter-clockwise direction from the initial position of the maneuvers for applying/withdrawing said latch, and between these first and second arms, said lift-bar has a countersunk hole from front to back that is disaligned with said first and second openings in the direction of a large relative separation from said radial projection, and in a manner and means such that the wall of said countersunk hole remains opposite and appreciably parallel relative to the side of a conical point of said counter-spring push-button that has a head adjacent to said second opening; and holding said support, a pair of diametrically opposed claws that are covered up [overlapped] in a rotating manner between reciprocal sockets of said static body by means of a second counterclockwise rotating path effected by the joining of said cylinder and support immediately for continuation of said first path.

The functioning of this new design that is proposed consists of: by activating the push-button up to its point, the conical side of the latter falls over the conical wall of the countersunk hole of the lift-bar, which climbs by rotating around its articulated assembly with the retracting catch piece, and by establishing a new rotary articulation relative to said push-button that now in its front part is placed across said countersunk hole; with this ascent, the end of the second arm of the lift-bar is interposed in the counterclockwise path (seen from the outside of the door) of the radial projection of the clip washer, and by pushing this latter until the lift-bar tilts and with its first arm propels the retraction of the retractable catch piece, which leaves the radial slot of the static body attached to the door; upon continuing the rotary propulsion of the cylinder, the retraction of the catch piece (now outside the radial slot) is sustained by the wall of the static body, and the assembly of radial projection-lift-catch piece is made rigid, with which now also the cylinder support rotates until the pair of claws of this support leave the sockets of the static body and the mutual coupling of the bayonet tip is undone, so that the cylinder can now be extracted from the outer front of the lock, which is done before the cylinder reaches the rotary position in that the latch is pushed out.

An important advantage of the invention consists of the fact that a cylinder of the conventional type and not a special type is employed; the only difference that is present is that the traditional clip-washer that is employed for its mounting is now equipped with a radial projection, in place of having a smooth edge, but the cost of this is insignificant when compared with the current option of having to produce a special cylinder.

Another advantage is that the extraction system is independent and compatible relative to the actuation and the opening and locking mechanism of the latch. This is done in such a way that the extraction of the cylinder can be verified both by the state of locking as well as that of opening, since the lock can be actuated from outside, without having to enter the residence or building that is affected.

Moreover, the user does not need to deliver a key to the locksmith; it is sufficient that he shows him the new key that he desires so that the locksmith prepares the set of slots of the corresponding combination.

BRIEF DESCRIPTION OF THE DRAWINGS

In order to better understand the nature of the present invention, we show in the attached drawings a preferential form of industrial embodiment, which has the nature of solely an illustrative example and is in no way limiting.

Figure 1:
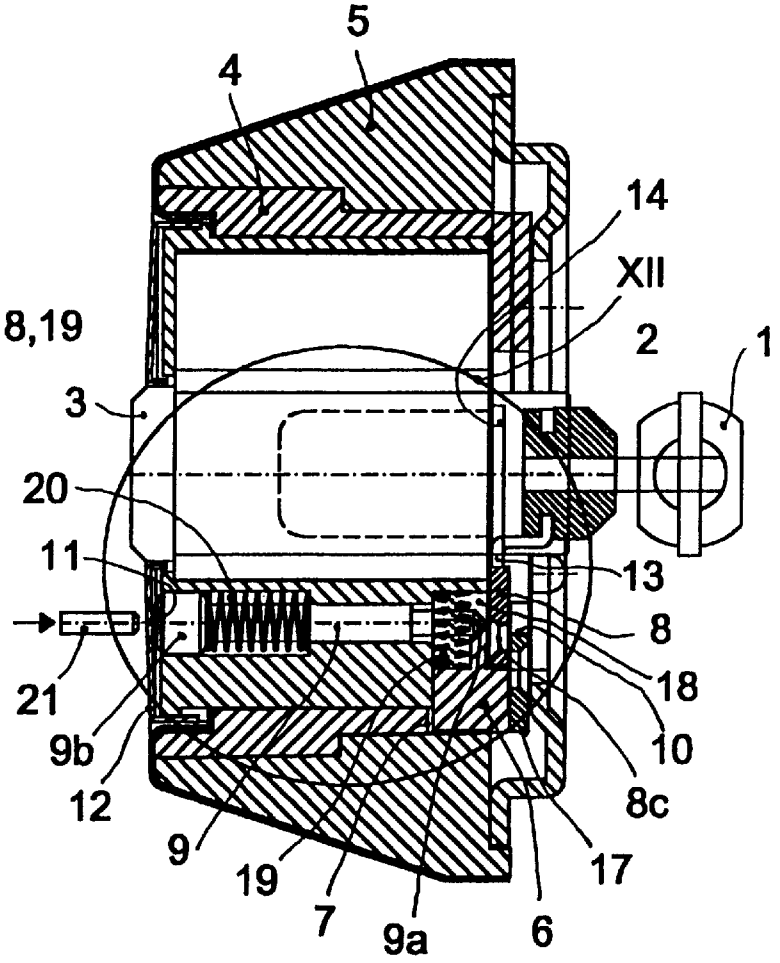
FIG. 1 shows the subject of the invention according to a cross section sectioned along line I—I, which is shown in FIG. 2, having incorporated the point of an actuation push-piece (21) of push-button (9). The position shown is that of mounting in normal functioning of latch (1), which is shown schematically, seen from behind.

In these figures, the following references are indicated:

1.—Latch

2.—Transverse axis [shaft]

3.—Combination cylinder

4.—Support

5.—Static body

6.—Radial retractable catch piece

7.—Radial slot

8.—Lift-bar

8*a*.—First arm

8*b*.—Second arm

8*c*.—Sunken hole

9.—Counter-spring push-button

9*a*.—Conical point

9*b*.—Head

10.—First opening

11.—Second opening

12.—Frontal escutcheon

13.—Radial projection

14.—Clip-washer

15.—Claws

16.—Sockets

17.—Cover

18.—Radial housing

19.—First antagonist spring

10.—Second antagonist spring

21.—Push-piece

DESCRIPTION OF A PREFERENTIAL EMBODIMENT

In relation to the drawings and to the references numbered above, a mode of preferential embodiment of the invention is illustrated in the attached plans; it particularly involves a latch (1) driven by a transverse shaft (2) that can be placed in rotation from a leg piece placed in the inside of a door, or from a combination cylinder (3), which is installed on the outside of said door and that is mounted by axial sliding from back to front in a support (4) that, in its turn, is mounted in a static body (5) attached to this door.

Figure 2:
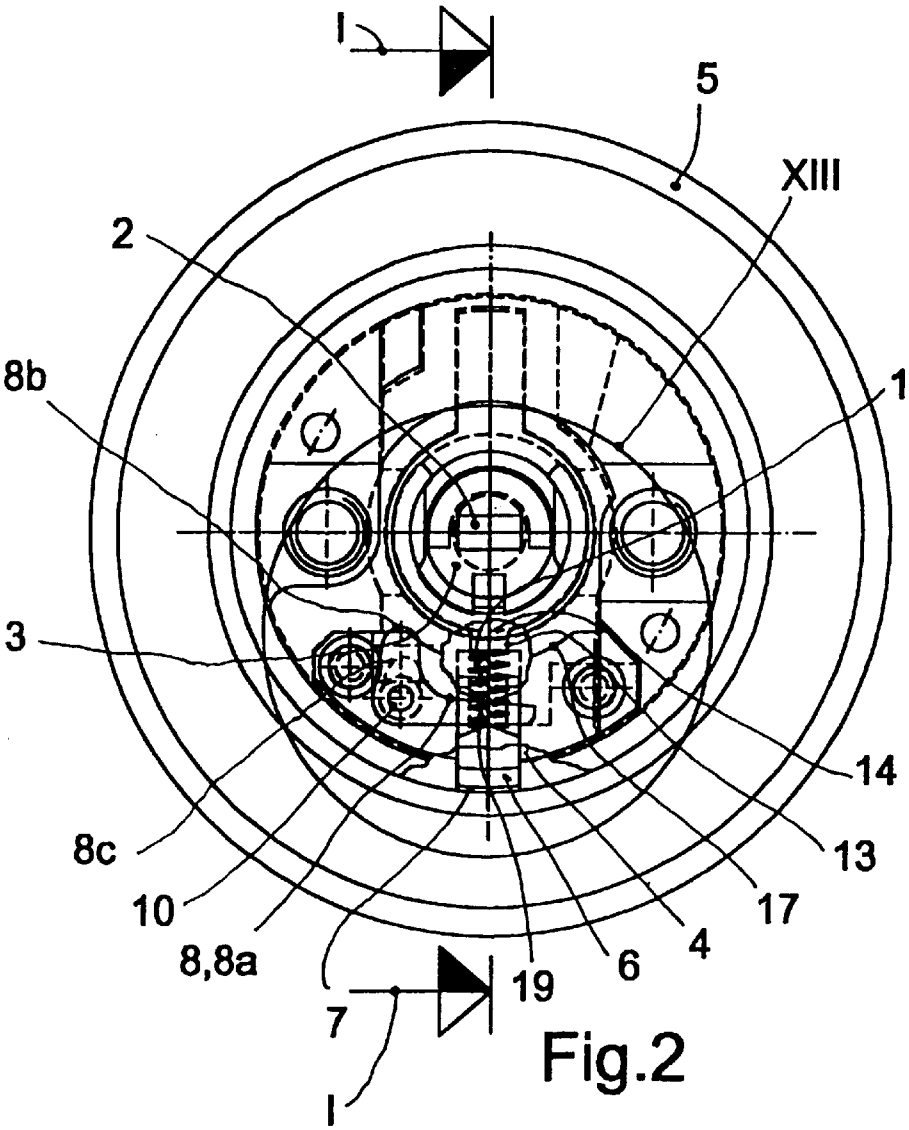
FIG. 2 is a lateral view corresponding to the subject sectioned in FIG. 1.
Figures 3, 4, 5, 6, 7, 8, 9, 10, 11:
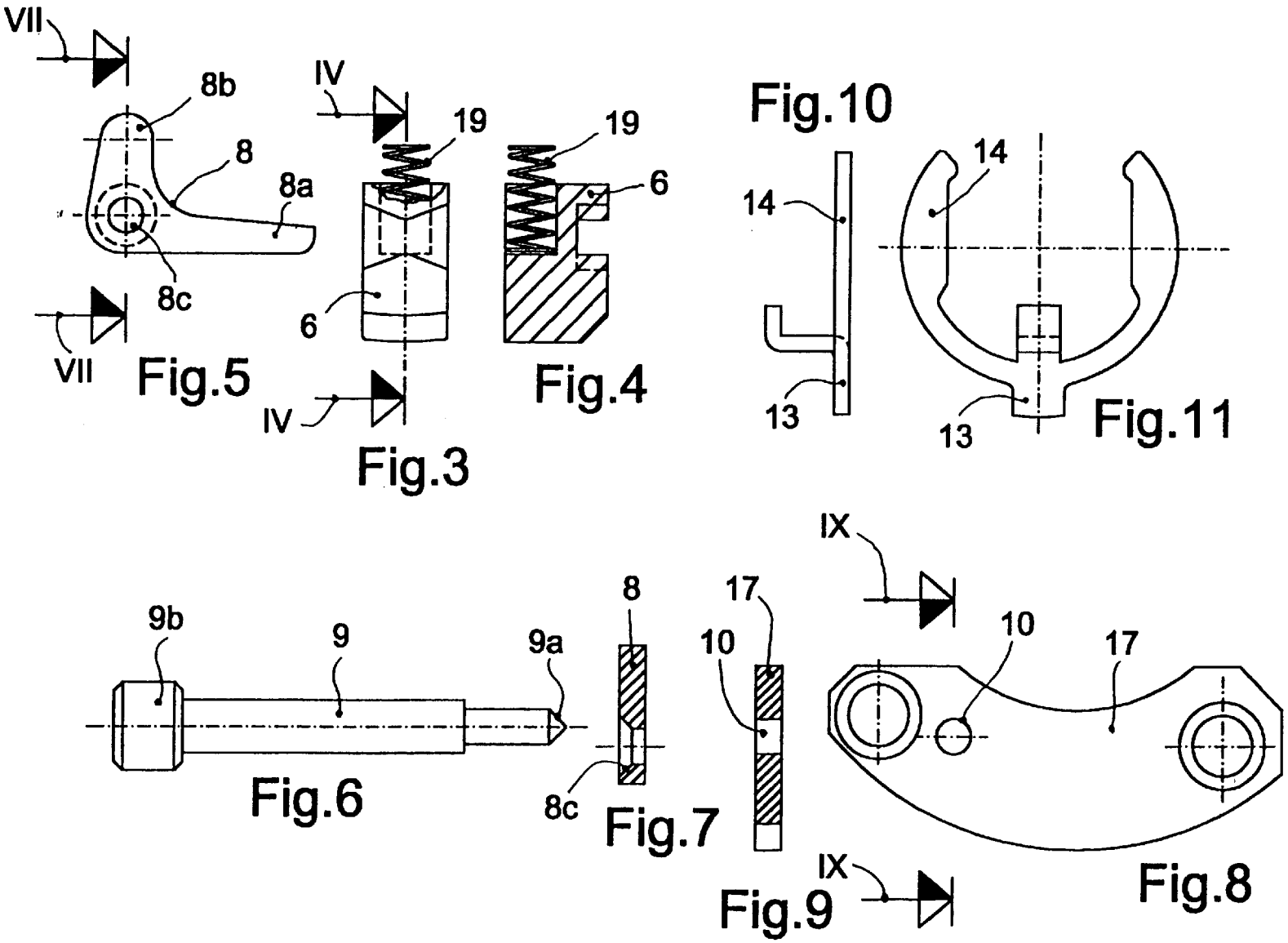
FIG. 3 shows the retractable catch piece (6) according to how it appears in FIG. 2, and is accompanied by the incorporation of the corresponding first antagonist spring (19).
FIG. 4 is a section IV—IV marked in FIG. 3.
FIG. 5 shows the lift-bar (8) according to how it appears in FIG. 2.
FIG. 6 shows push-button (9) according to how it appears in FIG. 1.
FIG. 7 shows the lift-bar (8) according to section VII—VII of FIG. 5 and aligned with push-button (9) of FIG. 6 according to how it appears in FIG. 1.
FIG. 8 shows cover (17) according to how it appears in FIG. 2.
FIG. 9 is section IX—IX of FIG. 8 and is aligned with said lift-bar (8) and push-button (9) of FIGS. 7 and 6 of the same mode that appears in the assembly of FIG. 1.
FIG. 10 shows the clip-washer (14) according to how it appears in the assembly of FIG. 1.
FIG. 11 is the front-back view of clip-washer (14) corresponding to FIG. 10.
Figure 12:
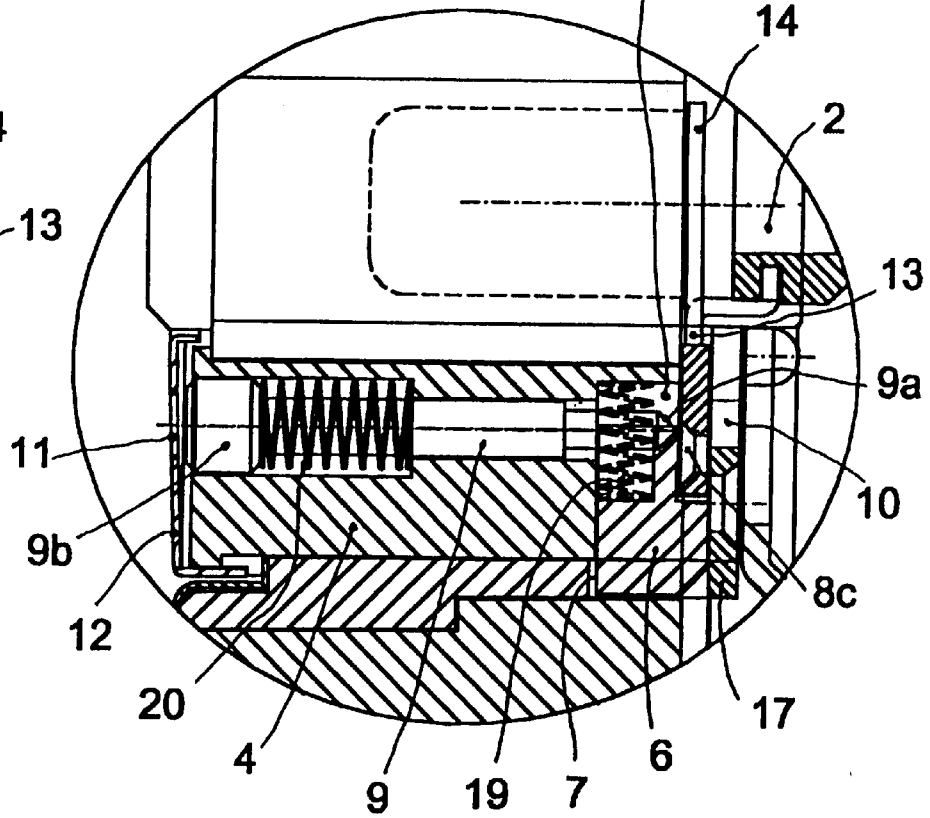
FIG. 12 is an enlargement of detail XII circled in FIG. 1.
Figure 13:
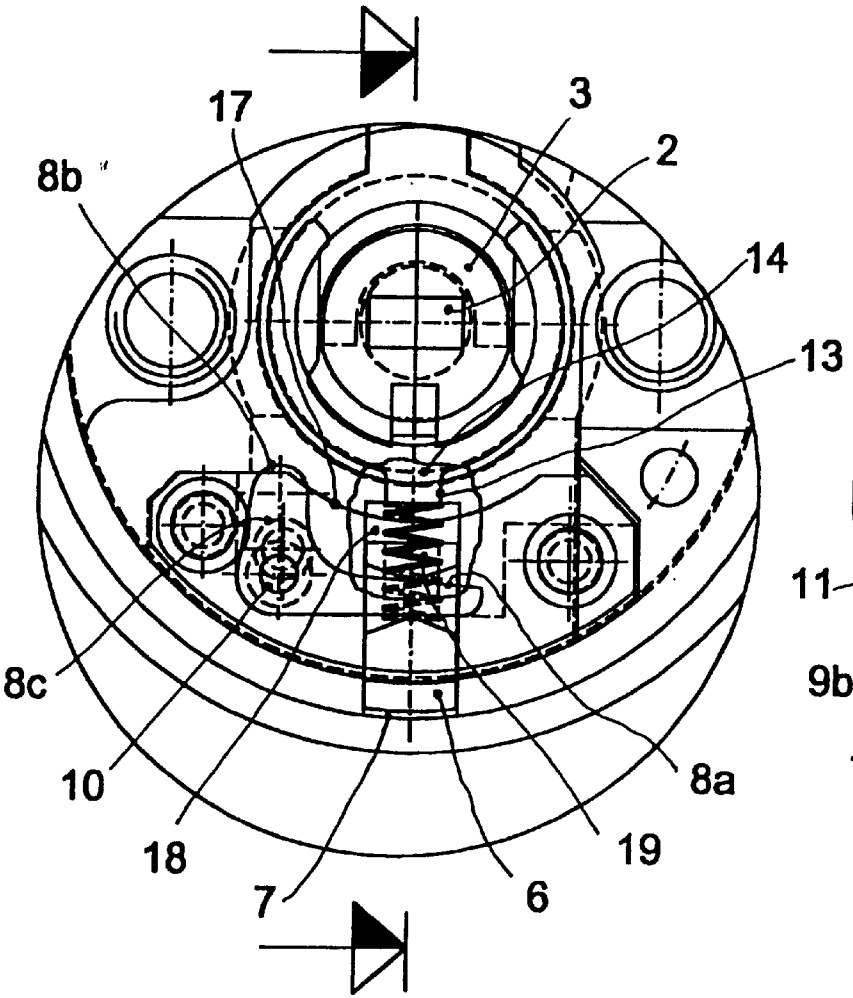
FIG. 13 shows enlargement of detail XIII circled in FIG. 2.

According to the essence of the invention, the referred-to support (4) has (FIGS. 1 and 2) a radial catch piece (6) that can be elastically retracted and is capable of adopting several retracted and extended positions, so that, with respect to the mounting state of this support (4), they are respectively outside and inside a reciprocal radial slot (7) of the internal wall of said static body (5); there is also a lift-bar (8) of transverse plane to said cylinder (3), a counter-spring push-button (9) parallel to said cylinder (3), one each first (10) and second (11) openings that are fixed in permanent axial alignment with said push-button (9), and that are respectively made in the back and in a front escutcheon (12) of said support (4) and a radial projection (13) formed in a clip-washer (14) of the type commonly used for intrinsic mounting of said cylinder (3); wherein, in relation to the state of mounting of said support (4), said lift-bar (8) has a first arm (8*a*) joined in articulation with said retractable catch piece (6), a second arm (8*b*) that has its end adjacent to a first rotary path effected by said radial projection (13) to rotate said cylinder (3) in the counterclockwise direction from the initial position of the application/retraction maneuvers of said latch (1), and, between these first (8*a*) and second (8*b*) arms, said lift-bar (8) has a front-back sunken hole (8*c*) that is not aligned with said first (10) and second (11) openings in the direction of a greater relative separation with respect to said radial projection (13) and in a manner and means so that the wall of said sunken hole (8*c*) remains opposite and appreciably parallel relative to the side of a conical point (9*a*) of a said counter-spring push-button (9) that has a head (9*b*) adjacent to said opening (11); and said support (4) having a pair of claws (15) diametrically opposed, which are covered up [overlapped] in rotation between mutual sockets (16) of said static body (5) by means of a second counterclockwise rotating path effected by the assembly of said cylinder (3) and support (4) immediately for continuation of said first path.

Figure 14:
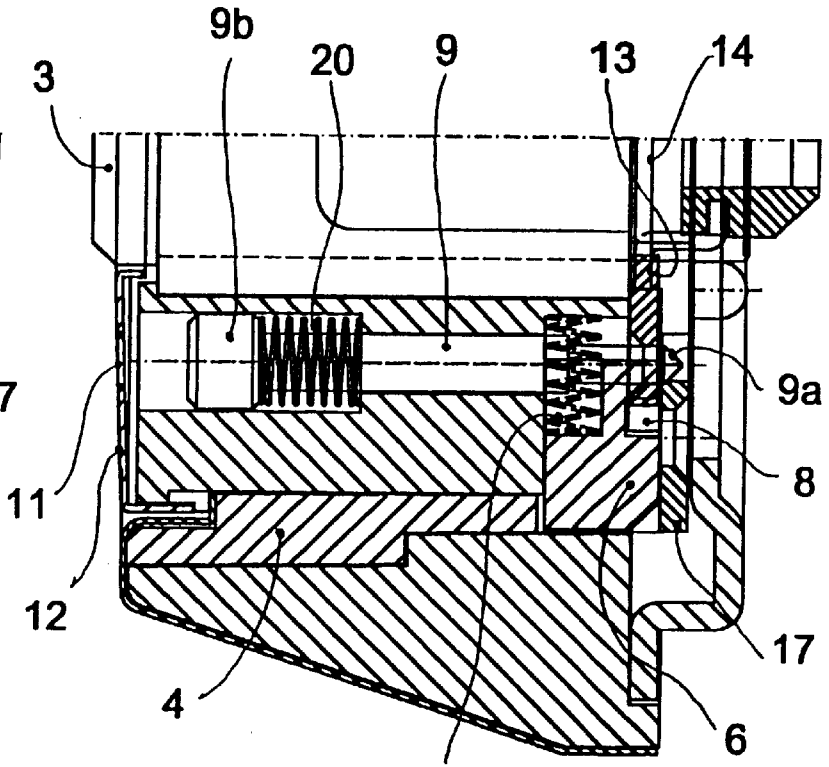
FIGS. 14 and 15 are respectively similar to FIGS. 1 and 2, although of smaller size and show the position of push-button (9) that has been pushed and has initiated the counterclockwise rotation of cylinder (3) but without catch piece (6) being retracted.
Figure 15:
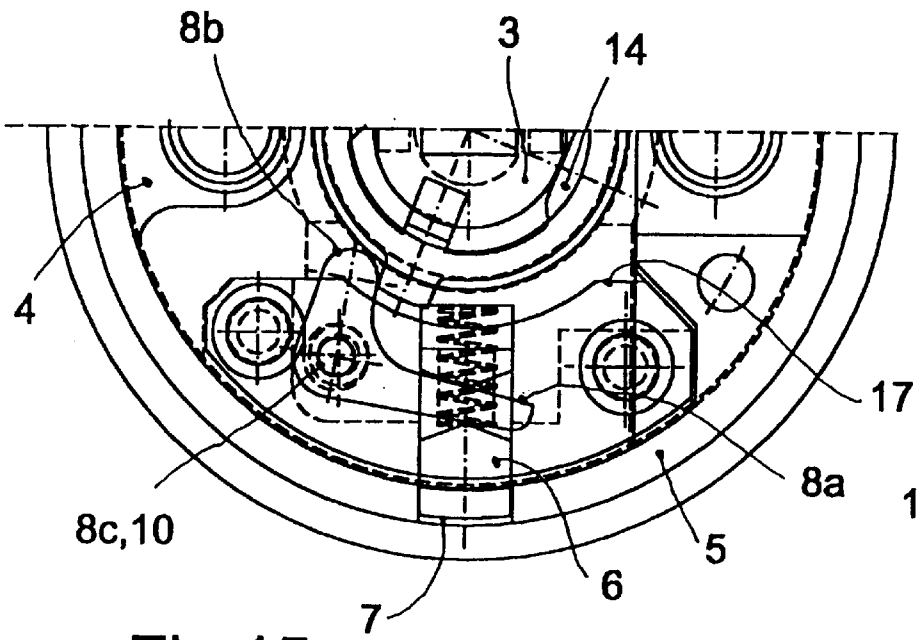
Figure 16:
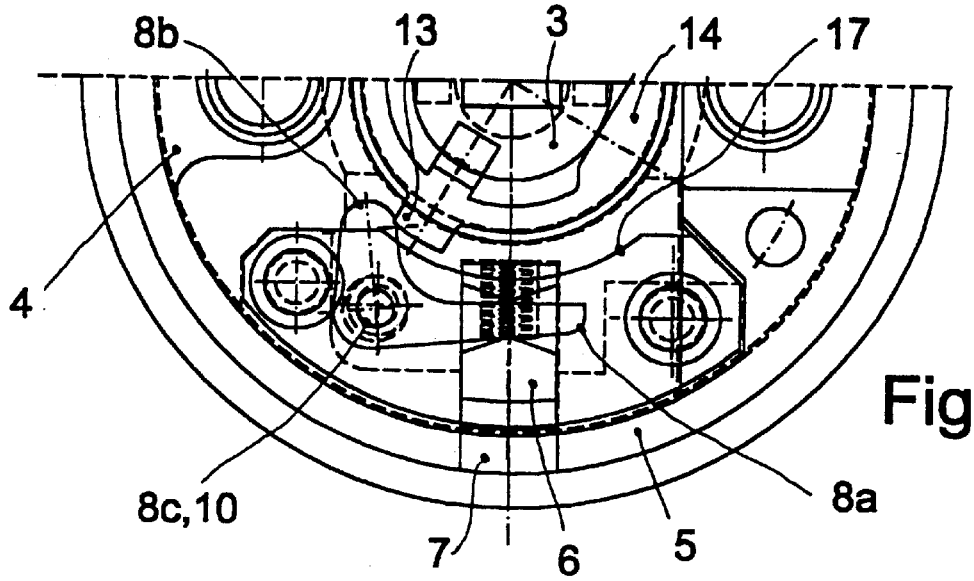
FIG. 16 is like FIG. 15, but shows catch piece (6) in the retracted position.
Figure 17:
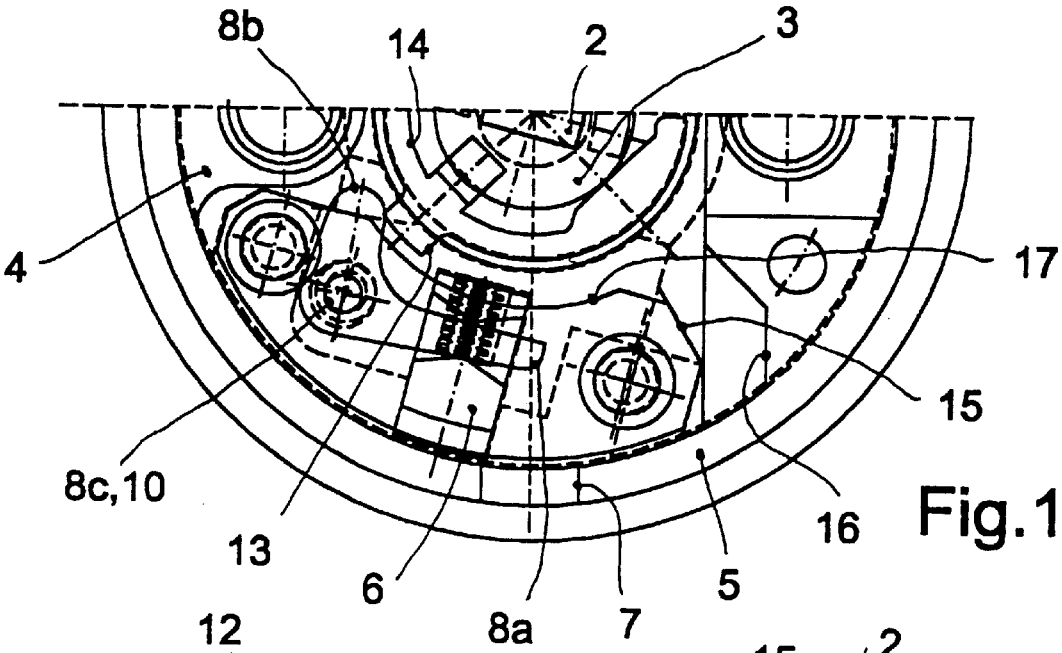
FIG. 17 is like FIGS. 15 and 16, but shows support (4) rotated until the bayonet coupler has been disconnected.
Figure 18:
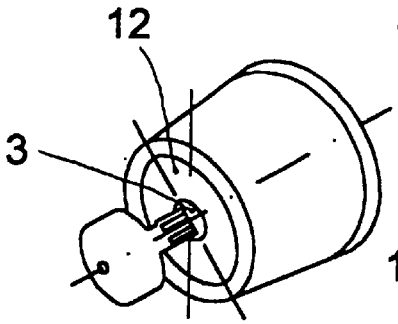
FIGS. 18 and 19 are perspective views that schematically illustrate the extraction of the cylinder-support assembly (3–4) corresponding to the position illustrated in FIG. 17.
Figure 19:
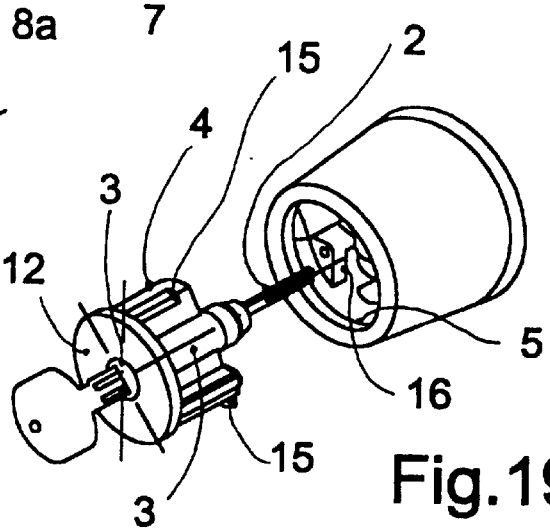

In order to extract cylinder (3) there is a push-piece (21) (FIG. 1), thinner in its front part, which can be the tool properly speaking, commonly used by locksmiths to proceed to the substitution of the set of slots of a conventional combination cylinder; by introducing it through second opening (11), made in frontal escutcheon (12), the pushed position of push-button (9) is driven, against its second antagonistic spring (20), until (FIG. 14) conical point (9*a*) passes through first opening (10) made in cover (17); for which, between this conical point (9*a*) and the conical wall of sunken hole (8*c*) of lift-bar (8) there is produced an effect of inclined plane that forces the latter to rise by (FIG. 15) free articulation of its first arm (8*a*) relative to retractable radial catch piece (6); then the counterclockwise rotation of cylinder (3) is initiated and radial projection (13) of clip-washer (14) reaches and pushes second arm (8*b*) causing lift-bar (8) to rotate now above push-button (9) and cause (FIG. 16) first arm (8*a*) to extract retractable catch piece (6) from radial slot (7) of static body (5); starting now, continuation of the rotary drive of cylinder (3) causes (FIG. 17) the entrainment of support (4), since a rigid connection has been established between radial projection (13), lift-bar (8) and retractable catch piece (6); as soon as this rotation succeeds in surpassing the cavity of the bayonet type coupler between the two claw-socket walls (15–16), cylinder (3) can be extracted (FIG. 19).

According to the invention, the sum of said rotating first and second paths is less than a rotating empty run that said cylinder (3) makes in this zone from the position of introduction of the key for working the application of the latch (1) until the latter begins its exit.

As has already been expressed, in this preferential embodiment, said first opening (10) is in a cover (17) that is mounted practically in the back of said support (4) and that seals in back a radial housing (18) in which is found said retractable catch piece (6).

Having sufficiently described the nature of the present invention as well as its industrial embodiment, it should only be added that it is possible to introduce changes in form, material and arrangement in its total assembly and constitutive parts, within the context of the invention, without such alterations being outside its principle.

What is claimed is:

1. Combination cylinder that can be extracted from the outside for a latch, particularly for a latch (1) driven by a transverse shaft (2) that can be placed in rotation from a leg piece placed inside the door or from a combination cylinder (3) installed outside said door, whose cylinder (3) is mounted by axial sliding from behind in a support (4) that is in turn mounted in a static body (5) fastened to said door, said static body (5) having an internal wall having a reciprocal radial slot (7), said latch having an initial position, said combination cylinder comprising: said support (4) having a radial catch piece (6) that is elastically retractable and capable of adopting several retracted and extended positions, which, with respect to the state of mounting of said support (4), are respectively outside and inside said reciprocal radial slot (7) of said internal wall of said static body (5); a lift-bar (8) of transverse plane to said cylinder (3), a counter-spring push-button (9) parallel to said cylinder (3), one each first (10) and second (11) openings that are fastened in permanent axial alignment with said push-button (9) and that are respectively made in the back and in a front escutcheon (12) of said support (4), and a radial projection (13) formed in a clip-washer (14); wherein, with respect to the mounting state of said support (4), said lift-bar (8) has a first arm (8*a*) assembled in articulation with said retractable catch piece (6), a second arm (8*b*), said second arm (8*b*) having an end adjacent to a first rotary path of said radial projection (13) upon rotating said cylinder (3) in counter-clockwise direction from said initial position of said latch (1), and, between said first (8*a*) and second (8*b*) arms, said lift-bar (8) has a front-back sunken hole (8*c*) that is out of alignment with said first (10) and second (11) openings in the direction of a greater relative separation with respect to said radial projection (13) and in a manner and means such that the wall of said sunken hole (8*c*) remains opposite and appreciably parallel with respect to the side of a conical point (9*a*) of a said counter-spring push-button (9) that has a head (9*b*) adjacent to said second opening (11); and said support (4) holding a pair of claws (15) diametrically opposed that are overlapped by rotating between reciprocal sockets (16) of said static body (5) by means of a second counter-clockwise rotating path effected by the assembly of said cylinder (3) and support (4) immediately for continuation of said first rotary path.

2. Combination cylinder that can be extracted from the outside for a latch according to claim 1, wherein the sum of said first and second rotating paths is less than an empty rotating course that said cylinder (3) makes from said initial position of said latch (1) until said latch (1) initiates extraction from said cylinder.

3. Combination cylinder that can be extracted from the outside for a latch according to claim 1, wherein said first opening (10) is in a cover (17) that is mounted in the back of said support (4) and that seals in back a radial housing (18), in which is located said retractable catch piece (6).

4. Combination cylinder that can be extracted from the outside for a latch according to claim 2, wherein said first opening (10) is in a cover (17) that is mounted in the back of said support (4) and that seals in back a radial housing (18), in which is located said retractable catch piece (6).

* * * * *